US009718643B2

(12) United States Patent
van der Meijden et al.

(10) Patent No.: US 9,718,643 B2
(45) Date of Patent: Aug. 1, 2017

(54) ELEVATOR ALIGNMENT TOOL

(71) Applicant: KONE CORPORATION, Helsinki (FI)

(72) Inventors: Gert van der Meijden, Otterlo (NL); Jos van den Heuvel, 's-Hertogenbosch (NL)

(73) Assignee: KONE CORPORATION, Helsinki (FI)

( * ) Notice: Subject to any disclaimer, the term of this patent is extended or adjusted under 35 U.S.C. 154(b) by 276 days.

(21) Appl. No.: 14/084,265

(22) Filed: Nov. 19, 2013

(65) Prior Publication Data

US 2014/0138189 A1 May 22, 2014

(30) Foreign Application Priority Data

Nov. 20, 2012 (EP) ..... 12193449

(51) Int. Cl.

| | |
|---|---|
| ***B66B 7/02*** | (2006.01) |
| ***B66B 5/00*** | (2006.01) |
| ***B66B 7/12*** | (2006.01) |

(52) U.S. Cl.

CPC ..... *B66B 7/02* (2013.01); *B66B 5/0087* (2013.01); *B66B 7/1246* (2013.01)

(58) Field of Classification Search

CPC ..... B66B 5/0087; B66B 7/02; B66B 7/1246
See application file for complete search history.

(56) References Cited

U.S. PATENT DOCUMENTS

| | | | | |
|---|---|---|---|---|
| 6,128,116 | A * | 10/2000 | Dobler et al. | 398/106 |
| 6,415,208 | B1 * | 7/2002 | Pojda | B61K 9/08 340/436 |
| 7,499,186 | B2 * | 3/2009 | Waisanen | 356/622 |
| 8,256,582 | B2 * | 9/2012 | Qiu | 187/406 |
| 8,302,319 | B1 * | 11/2012 | Chen | G01C 15/004 33/286 |
| 9,004,229 | B2 * | 4/2015 | Lindberg et al. | 187/391 |
| 2002/0104716 | A1 * | 8/2002 | Zaharia | 187/394 |
| 2009/0266651 | A1 * | 10/2009 | Van Der Meijden et al. | 187/408 |
| 2010/0287876 | A1 * | 11/2010 | Van Der Meijden et al. | 52/741.1 |
| 2010/0307871 | A1 * | 12/2010 | Kigawa | 187/344 |
| 2013/0206515 | A1 * | 8/2013 | Quinn | 187/250 |
| 2015/0217972 | A1 * | 8/2015 | Hawkins | G01C 15/10 187/391 |

FOREIGN PATENT DOCUMENTS

| | | | |
|---|---|---|---|
| DE | 202006007987 | U1 | 7/2006 |
| JP | 5-193865 | A | 8/1993 |
| WO | WO 93/23323 | A1 | 11/1993 |
| WO | WO 2007/135228 | A1 | 11/2007 |

* cited by examiner

*Primary Examiner* — William E Dondero
*Assistant Examiner* — Diem Tran
(74) *Attorney, Agent, or Firm* — Birch, Stewart, Kolasch & Birch, LLP

(57) ABSTRACT

An elevator alignment tool includes a longitudinal frame having rollers being configured to run along the surface of a guide rail of an elevator construction, which frame includes a bias device for biasing the frame against the guide rail and a connecting part configured to be connected to an elevator car or an installation time platform, which tool further includes a laser mounted to the frame. This alignment tool allows an easy alignment of new guide rails to be installed during elevator installation or an easy verification of the guide rail alignment of a ready built elevator construction.

19 Claims, 3 Drawing Sheets

ELEVATOR ALIGNMENT TOOL

Figure 1:
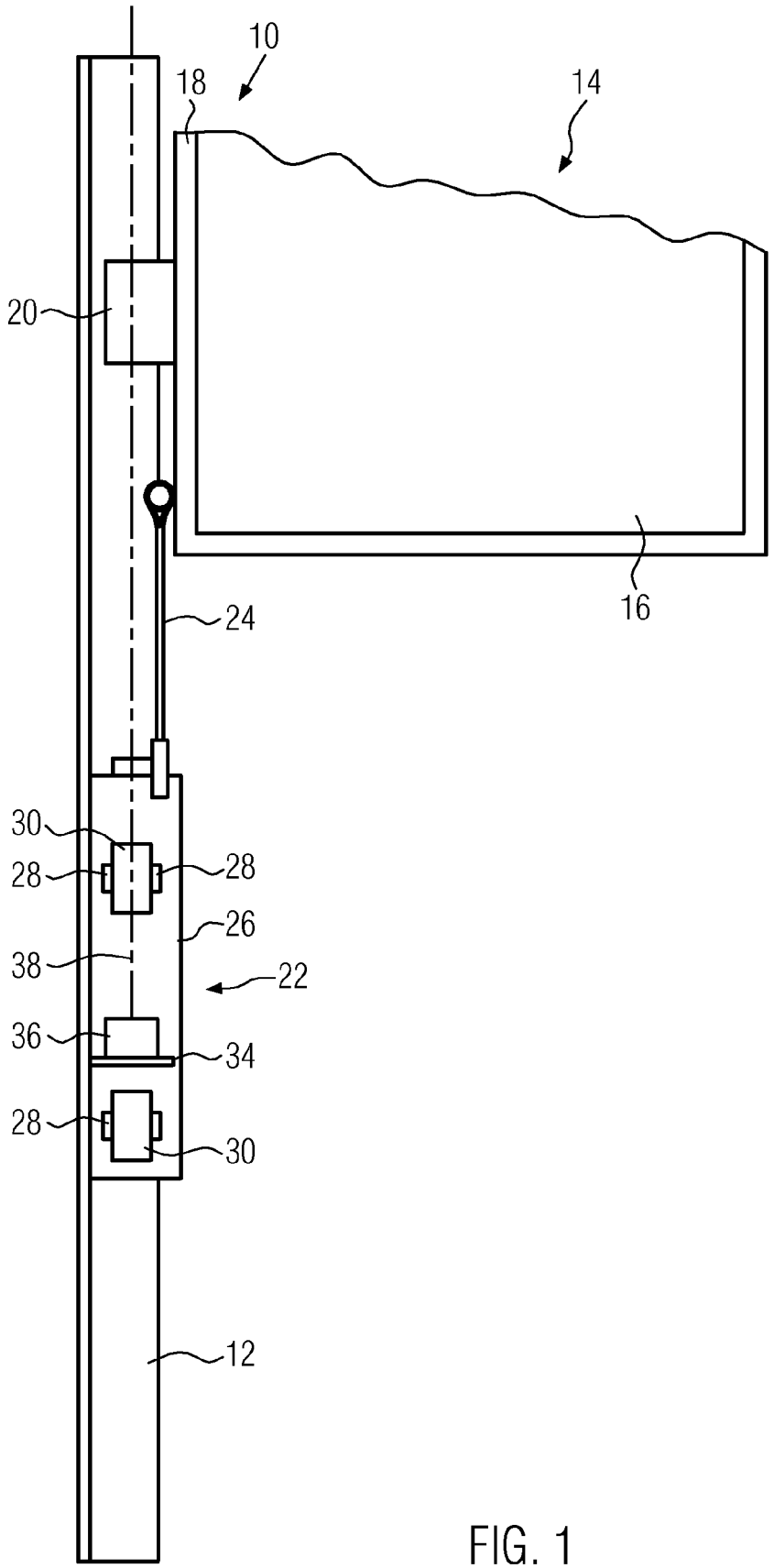

The present invention relates to an elevator alignment tool. Such tools are for example used during the installation of an elevator when at least the lower most guide rail part has already been installed and the car is already mounted in the elevator shaft and used as an installation platform during the buildup of the elevator. Of course, the inventive elevator alignment tool may also be used after completion of the elevator system during normal use of the elevator to monitor or verify the straightness of the elevator guide rails.

An elevator alignment tool is for example known from JP 5193865 showing a carrier moving along a guide rail which carrier has a reflecting surface to reflect a laser beam emitted by a laser mounted on the shaft pit or on the shaft top whereby the reflected beam is received by a receiver and used to get information about the accuracy of the guide rail straightness. The disadvantage of this device is that several devices have to be installed in the elevator shaft and a couple of adjustments are necessary. After the elevator installation has been completed these devices have to be dismounted.

It is therefore object of the invention to provide an alignment tool which easily allows the measurement or determination of the guide rail position in an easy manner.

According to the invention this object is solved with an alignment tool according to claim 1 and with an elevator having such an alignment tool according to claim 10. Preferred embodiments are subject matter of the corresponding dependent claims.

According to the invention the alignment tool comprises a longitudinal frame having rollers which are configured to roll along the surface of a guide rail of an elevator construction. The frame further comprises a bias means, for example a (e.g. counterside) spring means to keep the frame and accordingly the rollers of the frame in contact with the guide rail which allows the exact determination of the guide rail position via the continuous contact of the rollers of the alignment tool with at least one surface of the elevator guide rail.

Furthermore, the frame of the alignment tool comprises a connecting part which is configured to be connected to an elevator car or IT (Installation Time) platform. The connecting part may be for example simply one part, e.g. the end of the longitudinal frame which is connected via bolts or some other fixing means provided in connection with the elevator car. The connecting part can also be a rope which connects the frame of the alignment tool to the elevator car or IT platform in a vertical distance thereto, particularly below the elevator car. The alignment tool is connected to the car preferably with a rope, preferably a nylon rope or any type of chain, preferably light chain types.

One of the first steps during the installation of an elevator is the mounting of the lower most guide rails. Often already at this stage the car is brought into the elevator shaft because the car is used as an installation platform during the further buildup of the elevator in the upper direction. The inventive alignment tool is in the installation only used for the next guide rail lengths as it needs an already aligned guide rail length for its alignment function. Of course the alignment tool can later on be used as monitoring means for checking the proper alignment of all guide rail lengths, also the lowermost ones.

During installation the car may extend vertically above the already established guide rails. It is preferable when the alignment tool is connected to the elevator car or IT platform in the distance of about 2 to 5 meters below the elevator car or IT platform so that from the roof of the elevator car or IT platform the new guide rails may be connected to the elevator shaft while the alignment tool is in contact with the guide rails already mounted and adjusted in the elevator shaft.

It is preferable that the connecting part allows a play of the alignment tool in the horizontal plane with respect to the elevator car. This allows the alignment tool to keep contact with the guide rail although the elevator car itself may not yet be fixed in the horizontal plane via contact with already mounted guide rails.

Such a connection with a horizontal play can be obtained by providing resilient buffer elements between the connecting part and the elevator car and/or the connecting part and the frame.

Finally, the alignment tool further comprises a laser which is preferably arranged at the frame that the emitted laser beam extends vertically, i.e. parallel to the guide rail. This laser beam is then used for example during the installation of the elevator as a reference for the mounting of the new guide rails above the already mounted guide rail (s). The upper lengths of the guide rail are therefore mounted with the help of the alignment tool which is adjusted via its defined contact with the already mounted and adjusted guide rail length(s).

The invention has several advantages. In contrast to the prior art no components have to be installed in the elevator shaft which is already troublesome particular during the buildup of an elevator system.

By connecting the alignment tool to the elevator car the alignment tool easily follows the actual progress of construction work without needing any manual readjustment to a new position after a new length of guide rail has been mounted and the elevator car can be moved a further guide rail length in the upper direction of the shaft to install a new guide rail lengths above the already mounted ones.

As the alignment tool follows the elevator or IT platform car it does not obstruct the construction area on top of the elevator car or IT platform. The laser spot is near the guide rail which simplifies the adjustment of the new guide rail lengths above the already mounted one(s). Accordingly, shorter and lighter target plates can be used for the installation of new guide rail lengths. The invention provides a better and more accurate guide rail adjustment and also a faster guide rail adjustment. The laser beam can accordingly be arranged to extend along the front or back of the guide rail. If the laser is used in the front a smaller template can be used to position the first guide rail. As the mounting tool follows the car or IT platform in a distance of about 5 meters maximally the laser spot is always strong enough in the installation area on top of the car or IT platform.

As the alignment tool keeps in contact with the guide rail surface of already mounted guide rail length(s) preferably during the whole installation process no extra adjustment for the laser is necessary. During a break the laser has not to be closed away as the arrangement below the elevator car or IT platform is save against steeling. Furthermore, no realignment of the laser is necessary at each new stage of the progress of the construction work.

Preferably, the connection part is configured to be connected with an elevator car sling or IT platform which is on one hand the most rigid and reliable fixing area for the alignment tool at the elevator car or IT platform and furthermore, this does not require any drilling of holes in the cabin structure of the elevator car.

Preferably, the bias means comprises at least one, two or four magnets. The use of magnets as a bias means is very advantageous because no tensioning means has to be provided which would have to grip around the guide rail to press the frame of the alignment tool against a guide rail surface, although this is possible, too.

With at least one, preferably two, most preferably four magnets as bias means the biasing of the tool frame against the guide rail is possible although the frame extends only on one side of the elevator guide rail. This is particularly advantageous as often the back sides of guide rails are obstructed by brackets or other installation/mounting elements.

Preferably, the magnet(s) is/are fixed to the frame on the frame side facing the guide rail surface but it extends less in the direction of the guide rail surface than the rollers. By this measure the rollers are in contact with the guide rail surface whereas the magnets have a little distance to the guide rail which is small enough to provide a high magnetic force between the guide rail and the magnet so that the frame is kept in contact with the guide rail but is on the other hand wide enough to avoid a contact of the magnet with the guide rail surface.

Preferably, the frame of the alignment tool is a L-profile whereby both length of the profile have at least two rollers and at least one bias means, respectively. Preferably, in this case at least two magnets are used as bias means. The frame is fixedly kept via the bias means to two differently oriented surfaces of the guide rail, which are regularly oriented perpendicular to each other. Via this arrangement the alignment tool is kept in an exact position in the horizontal plane in connection with the guide rail. The position in the horizontal plane is therefore better defined than in a case where the alignment tool is in contact with only one surface of the guide rail. In this latter case additional guide rollers for an edge or a second surface of the guide rail have to be provided to keep the alignment tool in a defined relationship with respect to the guide rail (in the horizontal plane). If an L-profile is used as a frame the rollers of the frame are in contact with two differently oriented surfaces of the guide rail and thus the position of the alignment tool with respect to the guide rail is exactly defined without needing any guide means.

Preferably, the laser is mounted to the frame in such a way that the laser beam is emitted parallel to the longitudinal axis of the frame, preferably in the upper direction. With this arrangement the alignment tool can be easily used during the mounting of an elevator so that new guide rail lengths to be installed in the elevator shaft above the already mounted guide rail can easily be installed as the laser beam is directed vertically upwards where the new guide rail lengths are to be mounted. With corresponding templates the new guide rail length can then easily be adjusted as to exactly be aligned with the already mounted guide rail length(s).

Preferably, a horizontal mounting plate is connected to the frame for fixing the laser to the frame. It is very simple to adjust the laser on a horizontal mounting plate so that the laser beam can be adjusted as to emit vertically along the guide rail in a desired position.

Preferably, the frame has a first side facing the guide rail and a second side opposite to the guide rail. In an embodiment which is along the guide rail in a smooth way the bearing mountings for the rollers are mounted on the second side of the frame and the frame has a perforation for each roller so that the roller which is mounted via the bearing mountings on the second side of the frame extends from said second side through the perforation to the first side. This leads to the fact that the distance of the frame from the guide rail surface is very low which reduces vibrations or mutual movements of the frame with respect to the guide rail surface and which accordingly increases the accuracy of the laser beam.

In this last preferred embodiment the distance of the bearing in the bearing mounting from the second side of the frame is adjusted such that the roller extends through the perforation to the first side of a frame by a distance d1 which is slightly larger than a thickness d2 of at least one magnet which is fixed on the first side of the frame as a bias means. Via this arrangement the distance of the magnets from the guide rail surface is the difference of the distances dl and d2 which can be adjusted such that a high magnetic force is obtained between the guide rail and the frame and that on the other hand a contact between the magnet and the guide rail surface is avoided.

Of course, the invention also relates to an elevator comprising at least one elevator car moving along at least one elevator guide rail and an alignment tool according to one of the preceding claims. The alignment tool can be used in the elevator either as an alignment instrument to control the straightness of the elevator guide rails after the elevator construction has been terminated or during the installation of the elevator for aligning new guide rail lengths above the already mounted ones in the elevator shaft.

Preferably, the alignment tool is connected to the bottom of the elevator car or IT platform which is preferably advantageous for the elevator installation where the car roof is used as an installation platform for the mounting of the new guide rail lengths above the already mounted guide rail lengths.

Preferably, the car or IT platform has a safety gear and the laser is arranged below the car or IT platform such that the laser beam which emitted by the laser is pointing vertically between the safety gear levers. Via this measure the vertical laser beam can be kept in close distance to a guide rail surface without being obstructed by the safety gear of the elevator car or IT platform.

Advantageously the alignment tool is connected to the car or IT platform via a rope or chain, whereby a nylon rope or a light chain type are preferred.

Preferably, the elevator comprises at least one buffer in the shaft pit for any emergency drops of the car and the tool is connected to the elevator car in a way so as to extend between the buffer and the guide rail in the lower most position of the car. By this means the mounting of the alignment tool does not interfere with safety components of the elevator car in the shaft pit.

The above mentioned preferred embodiments of the invention may be combined arbitrarily as long as this is not in contradiction with the corresponding technical features of the embodiments.

Figure 2:
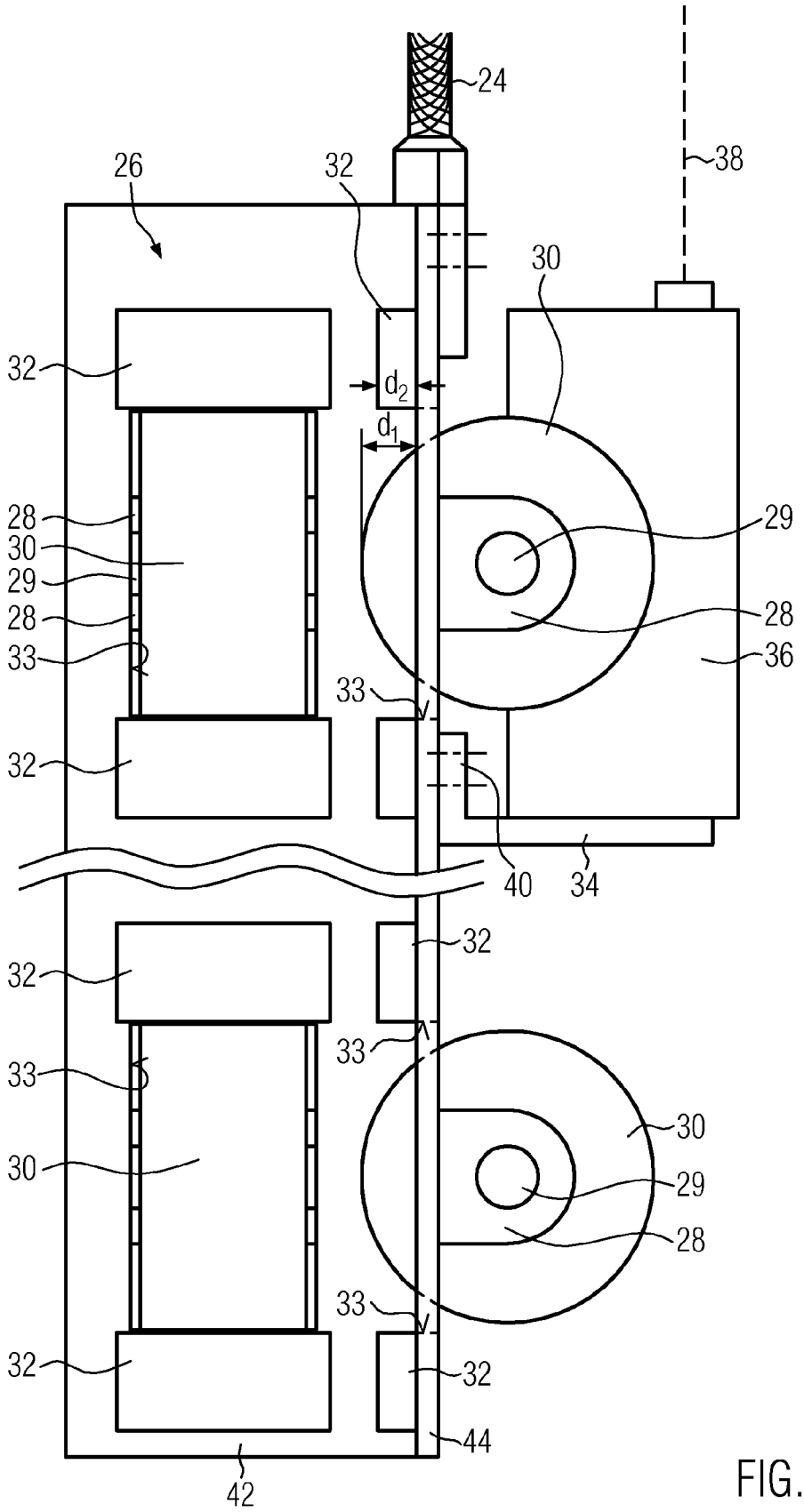
Figure 3:
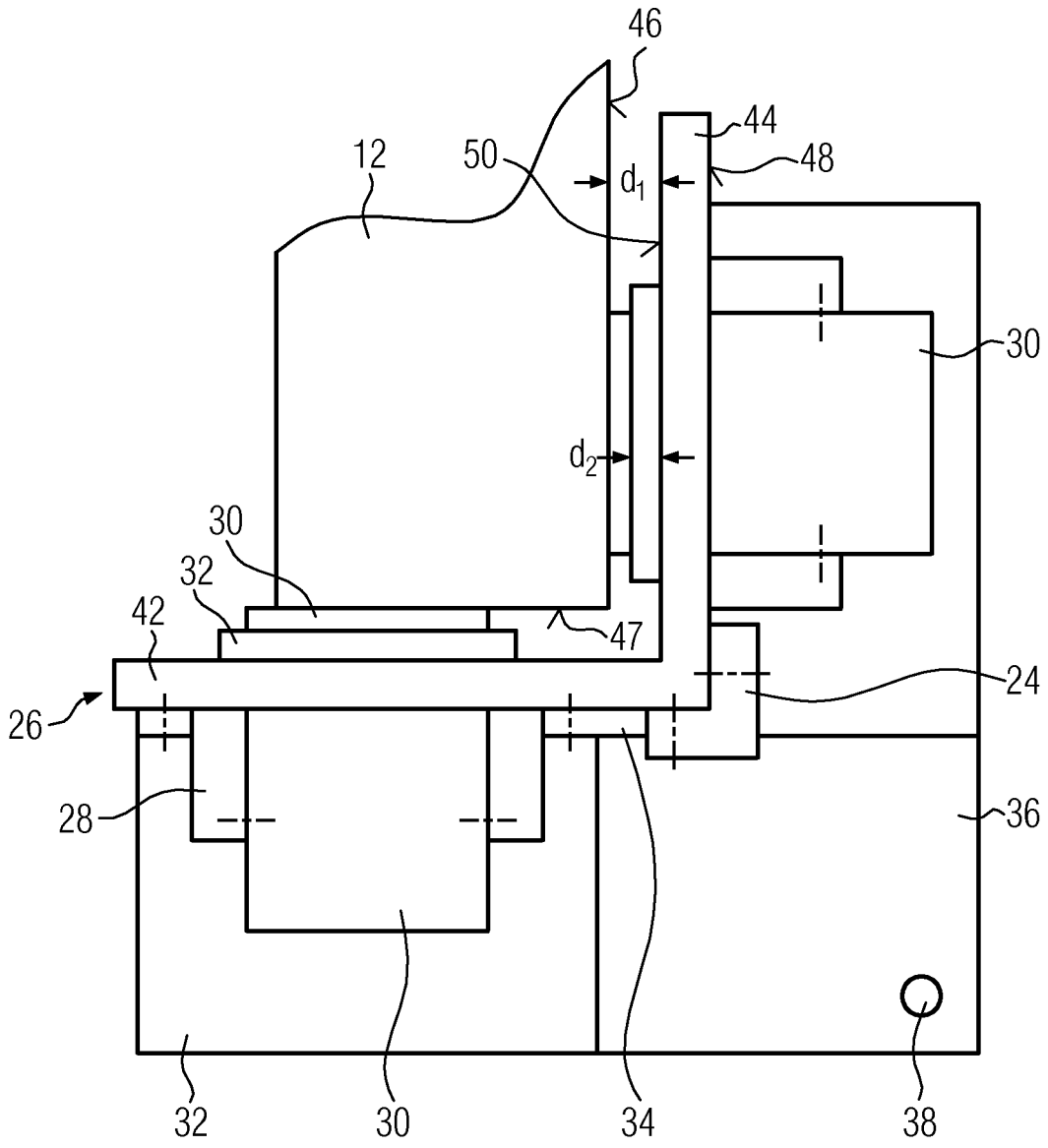

The invention is now described by a preferred embodiment with the aid of the schematic drawings. In these drawings:

FIG. 1 shows a schematical drawing of the alignment tool, a guide rail and a part of the elevator car, FIG. 2 shows an enlarged side view of the alignment tool of FIG. 1, and FIG. 3 shows a top view of the alignment tool of FIG. 1.

FIG. 1 shows an elevator construction 10 comprising a guide rail 12 and an elevator car 14 which consists of an elevator cabin 16 mounted in a frame or car sling 18 which extends completely around the elevator cabin and is used to mount the car in the shaft and to carry car components as guide rollers and safety gears 20. Instead of the car also an IT platform can be used. An alignment tool 22 is connected to the car sling 18 via a connecting rope 24 as connecting part. The connecting rope 24 is fixed to the upper end of a frame 26 of the alignment tool 22 which is embodied as L-profile (see FIGS. 2 and 3).

The frame comprises bearing mountings 28 carrying rollers 30 which are running on the surface of the guide rail and keep the frame 26 in close distance to the guide rail surface. The frame further carries magnets 32 on the side facing the guide rail 12 (see FIGS. 2 and 3). The magnets are kept by the rollers in a short distance to the guide rail surface so that the magnetic force between the guide rail and the frame keeps the frame fixedly biased to the guide rail surface. The frame further comprises a horizontal mounting plate 34 on which a laser 36 is adjusted and mounted so that the emitted laser beam 38 extends along the longitudinal axis of the frame and accordingly along the guide rail 12.

The horizontal mounting plate 34 is mounted with a flange 40 and bolts to the frame 26 (can only be seen in FIG. 2).

As it can be seen from FIGS. 2 and 3 the frame 26 is an L-profile consisting of two flanks 42, 44 which are oriented perpendicular to each other. Each flank has a first side 50 facing the guide rail surface and a second side 48 opposite to the guide rail surface 46, 47. Each of the flanks carry bearing mountings 28 on the second side 48 carrying rollers 30 and magnets 32 on the first side 50 with a thickness d2. The magnets 32 are kept in a short distance with respect to the guide rail surface 46, which corresponds to the distance dl of the rollers 30 extending through the first side 50 of the frame in the direction of the guide rail surface 46, 47 minus the thickness d2 of the magnets.

This distance dl minus d2 of the magnets 32 from the surface 46, 47 of the guide rail 12 is adjusted such that the magnetic force between the frame 26 and the surfaces 46, 47 of the guide rail is high but that on the other hand the magnets 32 do not touch the guide rail surfaces 46, 47. In the embodiment of FIGS. 2 and 3 the flank 44 covers one guide rail surface 46 and the other flank 42 perpendicular to the other covers a perpendicular guide rail surface 47 so that the frame 26 is kept in a defined position in the horizontal plane.

It shall be clarified that the drawing is only schematical. Accordingly, the relative dimensions of the components may deviate essentially from that shown in the figure.

It shall be clear that the invention can be modified from the described embodiment within the scope of the appended claims.

The invention claimed is:

1. An elevator alignment tool comprising:

a frame having rollers being configured to run along the surface of a guide rail of an elevator construction, the frame comprising a bias device configured to bias the frame against the guide rail and a connecting part configured to be connected to an elevator car or an installation time platform, the elevator alignment tool further comprises a laser mounted to the frame.

2. The elevator alignment tool according to claim 1, wherein the connecting part is a rope configured to be connected with an elevator car sling for the elevator car or the installation time platform.

3. The elevator alignment tool according to claim 2, wherein the bias device comprises at least one magnet.

4. The elevator alignment tool according to claim 2, wherein the frame is an L-profile, wherein both flanks of the L-profile have at least two rollers and the bias device is provided in plurality such that each flank includes at least one bias device of the plurality of bias devices.

5. The elevator alignment tool according to claim 1, wherein the bias device comprises at least one magnet.

6. The elevator alignment tool according to claim 5, wherein the at least one magnet is fixed to the frame on a first side facing the guide rail and has a thickness less than an extension of the rollers from the frame in a direction towards the guide rail.

7. The elevator alignment tool according to claim 1, wherein the frame is an L-profile, wherein both flanks of the L-profile have at least two rollers and at least one bias device.

8. The elevator alignment tool according to claim 1, wherein the laser is mounted to the frame so that a laser beam is emitted parallel to a longitudinal axis of the frame.

9. The elevator alignment tool according to claim 1, wherein a horizontal mounting plate is connected to the frame for fixing of the laser to the frame.

10. The elevator alignment tool according to claim 1, wherein the frame has a first side facing the guide rail and a second side opposite to the guide rail, and wherein bearing mountings for the rollers are mounted on the second side of the frame, and wherein the frame has a perforation for each roller so that each roller extends from the second side through the perforation to the first side.

11. The elevator alignment tool according to claim 10, wherein a distance of a roller axle in the bearing mounting from the second side of the frame is such that each roller extends through the perforation to the first side of the frame by a distance which is slightly larger than a thickness of a magnet fixed to the first side of the frame, and wherein the magnet is the bias device.

12. The elevator alignment tool according to claim 1, wherein the laser is mounted to the frame so that a laser beam is emitted parallel to a longitudinal axis of the frame in the upper direction.

13. The elevator alignment tool according to claim 1, wherein the connecting part is a rope or chain configured to be connected with an elevator car sling for the elevator car or the installation time platform and the elevator tool is configured to be located below the elevator car.

14. An elevator comprising an elevator car moving along an elevator guide rail and an elevator alignment tool, wherein the elevator alignment tool includes a frame having rollers being configured to run along the surface of the guide rail, the frame comprises a bias device configured to bias the frame against the guide rail and a connecting part configured to be connected to the elevator car, and wherein the elevator alignment tool further comprises a laser mounted to the frame.

15. The elevator according to claim 14, wherein the elevator alignment tool is mounted to a bottom of the elevator car.

16. The elevator according to claim 14, wherein the connecting part of the elevator alignment tool is connected to a car sling of the elevator car.

17. The elevator according to claim 14, wherein the connecting part is a rope.

18. The elevator according to claim 14, wherein the frame is an L-profile with two flanks, both carrying rollers and the bias device such that the rollers of both flanks are in contact with two differently oriented surfaces of the guide rail.

19. The elevator according to claim 14, wherein the connecting part is a rope with a length of at least two meters.

* * * * *